US008906172B2

(12) United States Patent
Gong et al.

(10) Patent No.: US 8,906,172 B2
(45) Date of Patent: Dec. 9, 2014

(54) AMORPHOUS ALLOY COMPOSITE MATERIAL AND MANUFACTURING METHOD OF THE SAME

(75) Inventors: Qing Gong, Shenzhen (CN); Zhijun Ma, Shenzhen (CN); Jiangtao Qu, Shenzhen (CN); Zengyan Guo, Shenzhen (CN); Faliang Zhang, Shenzhen (CN)

(73) Assignee: BYD Company Limited (CN)

( * ) Notice: Subject to any disclaimer, the term of this patent is extended or adjusted under 35 U.S.C. 154(b) by 376 days.

(21) Appl. No.: 13/319,994

(22) PCT Filed: May 11, 2010

(86) PCT No.: PCT/CN2010/072643

§ 371 (c)(1),
(2), (4) Date: Nov. 10, 2011

(87) PCT Pub. No.: WO2010/130199

PCT Pub. Date: Nov. 18, 2010

(65) Prior Publication Data

US 2012/0067466 A1 Mar. 22, 2012

(30) Foreign Application Priority Data

May 14, 2009 (CN) ..... 2009 1 0137567

(51) Int. Cl.
*C22C 45/10* (2006.01)
*C22C 1/00* (2006.01)

(52) U.S. Cl.
CPC ..... *C22C 45/10* (2013.01); *C22C 1/002* (2013.01)
USPC ..... 148/403; 420/423

(58) Field of Classification Search
None
See application file for complete search history.

(56) References Cited

U.S. PATENT DOCUMENTS

| | | | | |
|---|---|---|---|---|
| 5,288,344 | A | 2/1994 | Peker et al. | |
| 5,368,659 | A | 11/1994 | Peker et al. | |
| 5,567,251 | A * | 10/1996 | Peker et al. | 148/522 |
| 5,797,443 | A | 8/1998 | Lin et al. | |
| 6,261,386 | B1 * | 7/2001 | Perepezko et al. | 148/302 |
| 6,374,899 | B1 | 4/2002 | Yamaguchi et al. | |
| 6,562,156 | B2 | 5/2003 | Liu | |
| 6,682,611 | B2 | 1/2004 | Zhang et al. | |
| 6,709,536 | B1 | 3/2004 | Kim et al. | |
| 6,805,758 | B2 | 10/2004 | Wolter | |
| 6,896,750 | B2 | 5/2005 | Wolter | |
| 6,918,973 | B2 * | 7/2005 | Hufnagel et al. | 148/538 |
| 7,008,490 | B2 | 3/2006 | Peker | |
| 7,153,376 | B2 | 12/2006 | Wolter | |
| 7,244,321 | B2 | 7/2007 | Kim et al. | |
| 7,357,731 | B2 | 4/2008 | Johnson et al. | |
| 2003/0075246 | A1 | 4/2003 | Peker | |
| 2003/0217790 | A1 | 11/2003 | Wolter | |
| 2004/0084114 | A1 | 5/2004 | Wolter | |
| 2004/0216812 | A1 | 11/2004 | Wolter | |
| 2006/0108033 | A1 | 5/2006 | Peker et al. | |
| 2006/0154745 | A1 | 7/2006 | Johnson et al. | |
| 2007/0107810 | A1 | 5/2007 | Farmer | |
| 2007/0131312 | A1 | 6/2007 | Kim et al. | |
| 2008/0190521 | A1 | 8/2008 | Loffler et al. | |
| 2008/0202649 | A1 * | 8/2008 | Guo et al. | 148/561 |
| 2009/0139612 | A1 | 6/2009 | Lu et al. | |
| 2011/0048587 | A1 * | 3/2011 | Vecchio et al. | 148/561 |
| 2011/0094633 | A1 | 4/2011 | Gong et al. | |
| 2011/0097237 | A1 | 4/2011 | Gong et al. | |
| 2011/0280761 | A1 | 11/2011 | Gong et al. | |
| 2011/0308671 | A1 | 12/2011 | Gong et al. | |
| 2012/0067466 | A1 | 3/2012 | Gong et al. | |
| 2012/0073706 | A1 | 3/2012 | Gong et al. | |
| 2012/0073707 | A1 | 3/2012 | Gong et al. | |
| 2012/0073709 | A1 | 3/2012 | Gong et al. | |

FOREIGN PATENT DOCUMENTS

| | | | |
|---|---|---|---|
| CN | 1548572 | A | 11/2004 |
| EP | 2103699 | A1 | 9/2009 |
| JP | 2000234156 | A | 8/2000 |
| WO | WO 2010/130199 | A1 | 11/2010 |
| WO | WO 2011050695 | A1 | 5/2011 |

OTHER PUBLICATIONS

He Lin et al., Effect of Oxygen on the Thermal Stability of Zr—Cu—Ni—Al—Ti Bulk Amorphous Alloy; Feb. 2006; vol. 42, No. 2; pp. 134-138; ACTA Metallurgica Sinica.

Patent Abstracts of Japan; Abstract for Japanese Publication No. 2000-234156; Downloaded from www.19.ipdl.inpit.go.jp/PA1/result/detail/main/wj6ljyaDA412234156P1.htm; Aug. 29, 2000; One page; Japan.

Jiang, F. et al.; "Formation of Zr-Based Bulk Metallic Glasses from Low Purity Materials by Scandium Addition;" Scripta Materialla, vol. 53, pp. 487-491; Jun. 2005.

Patent Cooperation Treaty; International Search Report Issued in Connection with International Application No. PCT/CN2010/078014; Jan. 27, 2011; 5 pages; China.

(Continued)

*Primary Examiner* — George Wyszomierski

(74) *Attorney, Agent, or Firm* — Greenberg Traurig, LLP

(57) ABSTRACT

The present disclosure discloses an amorphous alloy composite material comprises an amorphous and continuous matrix phase, and a plurality of equiaxed crystalline phases as reinforcing phases dispersed in the matrix phase. Oxygen content in the amorphous alloy composite material may be less than 2100 ppm. The present disclosure also discloses a method of preparing the same. With the equiaxed crystalline phases dispersed in the matrix phase, the plasticity of the amorphous alloy composite material may be improved considerably.

3 Claims, 2 Drawing Sheets

(56) References Cited

OTHER PUBLICATIONS

Patent Cooperation Treaty; PCT Written Opinion of the International Searching Authority; Issued in Connection with International Application No. PCT/CN2010/078014; Jan. 27, 2011; 6 pages; China.
U.S. Patent and Trademark Office; Non-Final Office Action Issued Against U.S. Appl. No. 12/890,063; Jan. 26, 2012; 9 pages; U.S.A.
U.S. Patent and Trademark Office; Non-Final Office Action Issued Against U.S. Appl. No. 13/310,128; Jan. 30, 2012; 9 pages; U.S.A.
U.S. Patent and Trademark Office; Non-Final Office Action Issued Against U.S. Appl. No. 12/904,497; Feb. 6, 2012; 13 pages; U.S.A.
U.S. Patent and Trademark Office; Non-Final Office Action Issued Against U.S. Appl. No. 13/148,725; Mar. 1, 2012; 9 pages; U.S.A.
U.S. Patent and Trademark Office; Non-Final Office Action Issued Against U.S. Appl. No. 13/310,018; Mar. 5, 2012; 8 pages; U.S.A.
Faliang Zhang; "Declaration Under 37 C.F.R § 1.132 of Faliang Zhang;" Jun. 4, 2012; 27 pages; U.S.A.
Patent Cooperation Treaty, PCT International Search Report Issued in Connection with International Application No. PCT/CN2010/072643; Aug. 12, 2010; 4 pages; China.
Patent Cooperation Treaty, PCT Written Opinion of the International Searching Authority Issued in Connection with International Application No. PCT/CN2010/072643; Aug. 12, 2010; 3 pages; China.
Joseph B. Milstein and Lionel F. Saunders; Gettering of Gases for High Purity Applications; Journal of Crystal Growth; 1988; pp. 124-130; North-Holland, Amsterdam.

* cited by examiner

AMORPHOUS ALLOY COMPOSITE MATERIAL AND MANUFACTURING METHOD OF THE SAME

CROSS-REFERENCE TO RELATED APPLICATION

This patent application is a §371 national stage patent application based on International Patent Application No. PCT/CN2010/072643, filed on May 11, 2010, entitled "AMORPHOUS ALLOY COMPOSITE MATERIAL AND METHOD OF PREPARING THE SAME," which claims the benefit and priority of Chinese Patent Application Number 200910137567.2, filed on May 14, 2009, which are all incorporated herein by reference in their entirety.

FIELD OF THE PRESENT DISCLOSURE

The present disclosure relates to amorphous alloy composite materials and methods of preparing the same.

BACKGROUND OF THE PRESENT DISCLOSURE

With structure features of long-range disorder and short-range order which provide properties of both glasses and metals, bulk amorphous alloys have excellent physical, chemical and mechanical properties, such as high strength, high hardness, high wear resistance, high corrosion resistance, high resistance, etc., which have been applied in a wide range of fields such as national defense equipments, precision machines, biomedical materials, electric information elements, chemical industries and so on. However, because bulk amorphous alloys have a plastic depth limited at a shear band with a width of from 5 nm to 20 nm, further deformation of the bulk amorphous alloys may soften the shear band, and finally result in fracture at the softened shear surface. Non-uniform deformation of this kind may cause catastrophic failure of the bulk amorphous alloys without significant macroscopic plastic deformation, which limits superior performances and wide applications in practical use of the bulk amorphous alloys.

In recent years, a variety of bulk amorphous alloy composite materials comprising an amorphous matrix phase and a crystalline reinforcing phase have been developed by introducing a second crystalline phase into an alloy melt or by precipitating a part of crystalline phase during crystallization, for improving the plastic performance by protecting a single shear band from running through a whole specimen and facilitating the formation of a plurality of shear bands.

For example, U.S. Pat. No. 6,709,536 discloses a composite amorphous metal object and a method of preparing the same. The composite amorphous metal object comprises an amorphous metal alloy forming a substantially continuous matrix and a second phase embedded in the matrix. And the second phase comprises ductile metal particles of a dendritic structure. The method of preparing the same comprises the steps of: heating an alloy above the melting point of the alloy; cooling the alloy between the liquidus and solidus of the alloy for sufficient time to form a ductile crystalline phase distributed in a liquid phase; and cooling the alloy to a temperature below the glass transition temperature of the liquid phase rapidly for forming an amorphous metal matrix around the crystalline phase. While U.S. Pat. No. 6,709,536 improves the plastic performance of the composite amorphous metal object by introducing a crystalline phase into the composite amorphous metal, the plastic performance thereof is still poor.

SUMMARY OF THE PRESENT DISCLOSURE

In viewing thereof, the present disclosure is directed to solve at least one of the problems existing in the prior art. Accordingly, an amorphous alloy composite material is needed to be provided with enhanced plastic property. Further, a method of preparing the same may need to be provided.

According to an embodiment of the present disclosure, an amorphous alloy composite material may be provided, which may comprise a matrix phase and a reinforcing phase. The matrix phase may be a continuous and amorphous phase; the reinforcing phase may comprise a plurality of equiaxed crystalline phases dispersed in the matrix phase. And the amorphous alloy composite material may have an oxygen content of less than about 2100 parts per million ("ppm").

In some embodiments, the amorphous alloy composite material may have a composition represented by the following general formula: $((Zr_{1-a}Hf_a)_bTi_cCu_dNi_eBe_f)_{100-x}Nb_x$, where:

a may represent an atomic weight ratio of Hf to a total atomic weight of Zr and Hf, ranging from about 0.01 to about 0.1;

b, c, d, e, and f are atomic weight ratios, b+c+d+e+f+100, where $50 \leq 65$, $10 \leq c \leq 20$, $2 \leq d \leq 10$, $1 \leq e \leq 10$, and $4 \leq f \leq 20$; and x may be an atomic weight ratio of Nb where $0<x<10$.

According to another embodiment of the present disclosure, a method of preparing the amorphous alloy composite material as described above is provided, which may comprise the steps of:

melting an alloy raw material under an atmosphere of a protective gas or vacuum; and cooling thereof. And an oxygen content in the amorphous alloy composite material is configured to be less than 2100 ppm by controlling the oxygen content in the alloy raw material as well as the condition of the protective gas or vacuum condition.

According to the present disclosure, the plurality of equiaxed crystalline phases are dispersed in the matrix phase with the oxygen content therein less than 2100 ppm, and thus the plasticity of the composite material is enhanced dramatically.

Additional aspects and advantages of the embodiments of present disclosure will be given in part in the following descriptions, become apparent in part from the following descriptions, or be learned from the practice of the embodiments of the present disclosure.

BRIEF DESCRIPTION OF THE DRAWINGS

These and other aspects and advantages of the present disclosure will become apparent and more readily appreciated from the following descriptions taken in conjunction with the drawings in which.

DETAILED DESCRIPTION OF THE EMBODIMENTS

Figure 1:
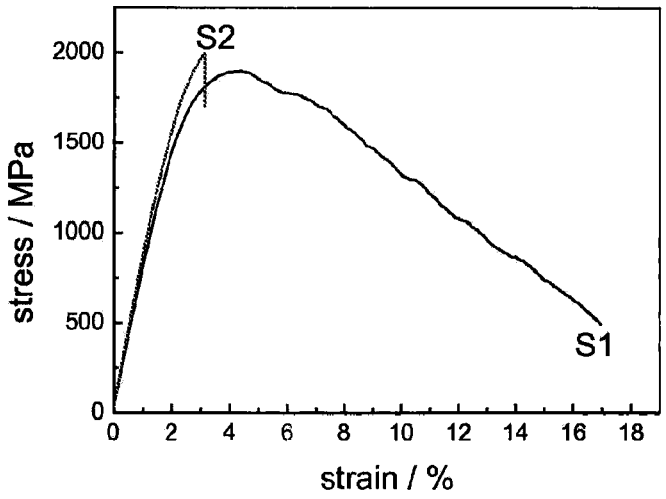
FIG. 1 shows a stress-strain curve of an amorphous alloy composite material according to an 10 embodiment of the present disclosure.

Reference will be made in detail to embodiments of the present disclosure. The embodiments described herein with reference to drawings are explanatory, illustrative, and used to generally understand the present disclosure. The embodiments shall not be construed to limit the present disclosure. The same or similar elements and the elements having same or similar functions are denoted by like reference numerals throughout the descriptions.

It has been found by the inventors of the present disclosure that the poor plasticity of the amorphous alloy composite material may be resulted from the dendritic crystalline phase formed because the oxygen content is not strictly controlled during preparing the amorphous alloy composite material which may result in the oxygen content in the composite material above 2100 ppm. It has also been found by the inventors of the present disclosure that, during preparing the amorphous alloy composite material, by controlling the oxygen content in the alloy raw material as well as the protective gas or the vacuum condition, an oxygen content in the amorphous alloy composite material may be controlled or configured to be less than 2100 ppm, which may form equiaxed crystalline phases and thus the plasticity of the amorphous alloy composite material obtained may be significantly improved accordingly.

According to an embodiment of the present disclosure, an amorphous alloy composite material may be provided, which may comprise a matrix phase and a reinforcing phase. The matrix phase may be a continuous and amorphous phase. The reinforcing phase may comprise a plurality of equiaxed crystalline phases dispersed in the matrix phase. And the amorphous alloy composite material may have an oxygen content of less than about 2100 ppm.

According to one embodiment of the present disclosure, there are no special limits on the contents of the matrix and reinforcing phases. However, according to an embodiment of the present disclosure, the content of the reinforcing phase is about 10% to 70% by volume, more particularly from about 30% to 50% by volume, and the content of the matrix phase is from about 30% to 90% by volume, more particularly from about 50% to 70% by volume, based on the total volume of the matrix phase and the reinforcing phase. According to some embodiments, the volume of the matrix and reinforcing phases may be determined by a method well known to those skilled in the art, such as the metallographic method for determining area contents of the phases or the quantitative metallography.

Theoretically, the lower the oxygen content in the composite material, the more favorable for the formation of equiaxed crystalline phases, thus improving the plasticity of the composite material whereas the cost thereof increasing accordingly. In consideration of cost and plasticity, the oxygen content in the amorphous alloy composite material is particularly ranging from about 200 ppm to 2000 ppm.

In some embodiments, principal crystal axes of the equiaxed crystalline phase have a size from about 5 microns ("um") to 30 um, and a front end of the crystalline phase has a curvature radius of not less than 500 nanometers ("nm").

In one embodiment, the matrix and reinforcing phases may have same or different compositions.

According to one embodiment of the present disclosure, there are no special limits on the compositions of the amorphous alloy composite material, and as long as the reinforcing phase is an equiaxed crystalline phase and the oxygen content in the amorphous alloy composite material is less than 2100 ppm, excellent plasticity may be achieved. In one particular embodiment, the amorphous alloy composite material has a composition as represented by the following general formula:

$$((Zr_{1-a}Hf_a)_bTi_cCu_dNi_eBe_f)_{100-x}Nb_x$$

where a is an atomic weight ratio of Hf to a total atomic weight of Zr and Hf, and $0.01<a<0.1$;

b, c, d, e, and f are atomic weight ratios, and $50\leq b\leq 65$, $10\leq c\leq 20$, $2\leq d\leq 10$, $1\leq e\leq 10$, and $4\leq f\leq 20$, and $b+c+d+e+f=100$; and x is the atomic weight ratio of Nb, and $0\leq x\leq 10$, and more particularly, $1\leq x\leq 6$.

Further, according to an embodiment of the present disclosure, a method for manufacturing the amorphous alloy composite material as described above may be provided, which may comprise the steps of melting an alloy raw material under a protective gas or vacuum; and then cooling the alloy raw material to obtain the amorphous alloy composite material. An oxygen content in the amorphous alloy composite material may be controlled or configured to be less than 2100 ppm by controlling the oxygen content in the alloy raw material as well as the protective gas or the vacuum condition.

In some embodiments, the protective gas may be a gas selected group 18 of the periodic table of elements.

In one embodiment, the vacuum degree of the vacuum condition may be from about $3\times10^{-5}$ 10 Pascal ("Pa") to $10^2$ Pa (absolute pressure).

In some embodiments, the oxygen content of the alloy raw material as well as the protective gas or the vacuum condition only need to meet the requirement that the oxygen content in the amorphous alloy composite material is less than 2100 ppm (particularly from about 200 ppm to 2000 ppm). According to an embodiment of the present disclosure, the oxygen content thereof may be less than 2100 ppm, and more particularly the oxygen content thereof may be about 150 ppm to 2000 ppm.

In some embodiments, the melting method may adopt those commonly used in the art, provided that the alloy raw material is melt sufficiently. For example, the alloy raw material may be melted in a melting equipment, and the melting temperature and time would vary according to different alloy raw materials. In one embodiment, the melting temperature may range from about 800° C. to 2700° C., more particularly from about 1000° C. to 2000° C. And the melting time may range from about 0.5 minutes to 5 minutes, more particularly from about 1 minute to 3 minutes. In some embodiments, the melting equipment may be those conventional ones, such as a vacuum arc melting furnace, a vacuum induction melting furnace, and a vacuum resistance furnace.

In some embodiments, the cooling method may be those known in the art, such as casting the alloy raw material (melt) into a mold and then cooling accordingly. For example, the casting method may be suction casting, spray casting, die casting, or gravity casting using the gravity of the melt itself. The mold may be formed from copper alloy, stainless steel or the like with a thermal conductivity ranging from about 30 watts per meter Kelvin ("W/m·K") to 400 W/m·K, more particularly from about 50 W/m·K to 200 W/m·K. The mold may be water cooled, liquid nitrogen cooled, or connected to a temperature controlling device.

During cooling, a part of the alloy may be precipitated as a crystalline phase and dispersed in the amorphous phase. In one particular embodiment, the cooling condition may allow the precipitated crystalline phase to have a volume percent of about 10% to 70% of the amorphous alloy composite material. For example, the temperature of the temperature controlling advice may be kept to be less than the glass transition temperature (Tg) of the alloy, particularly from about 20° C. to 30° C. The cooling process may have a speed from about 10 Kelvin per second ("K/s") to $10^5$ K/s, more particularly from about $10^2$ K/s to $10^4$ K/s.

In some embodiments, the alloy raw material may comprise Zr, Hf, Ti, Cu, Ni, Be and Nb. And the content percents thereof may satisfy the following general formula:

$$((Zr_{1-a}Hf_a)_bTi_cCu_dNi_eBe_f)_{100-x}Nb_x$$

where a is the atomic weight ratios of Hf to a total ratio weight of Zr and Hf, and $0.01 \le a \le 0.1$; b, c, d, e and f are atomic weight ratios, $50 \le b \le 65$, $10 \le c \le 20$, $2 \le d \le 10$, $1 \le e \le 10$, $4 \le f \le 20$, and $b+c+d+e+f=100$; and x is the atomic weight ratio of Nb, and $0 \le x \le 10$, more particularly $1 \le x \le 6$.

Hereinafter, exemplary embodiments of the present disclosure will be described with reference to the accompanying drawings.

Embodiment 1

An amorphous alloy composite material having a general formula of $((Zr_{0.98}Hf_{0.02})_{59}Ti_{15}Cu_7Ni_6Be_{13})_{95}Nb_5$ was prepared by the steps of:

1) preparing a mixture of $(Zr_{0.98}Hf_{0.02})$, Ti, Cu, Ni, Nb and Be:

mixing the compositions of $(Zr_{0.98}Hf_{0.02})$, Ti, Cu, Ni, Nb and Be each having a purity of 99.9% according to the atomic weight ratios as indicated in the general formula mentioned above to obtain a mixture, and an oxygen content was 600 ppm; and 2) preparing a sheet Si of $((Zr_{0.98}Hf_{0.02})_{59}Ti_{15}Cu_7Ni_6Be_{13})_{95}Nb_5$:

placing the mixture of Step 1) in a vacuum arc furnace of a fast solidification equipment; and melting the alloy raw material for 4 minutes under a temperature of 1100° C. using Ar as a protective gas (with a purity of 99.9%) to melt completely and to form an ingot; and then melting the ingot again and performing die casting by a mold on a vacuum die casting machine with the mold being cooled to room temperature by water at a cooling speed of 102K/s to form the sheet S1 of $((Zr_{0.98}Hf_{0.02})_{59}Ti_5Cu_7Ni_6Be_3)_{95}Nb_5$.

An oxygen content of the sheet SI was about 900 ppm as tested by a nitrogen-oxygen analyzer IRO-II nitrogen-oxygen analyzer provided by NCS Analytical Instruments Co., Ltd., Beijing, China.

The crystalline phase had a volume percent of 35% as tested by a metallographic method for determining area content of the phases.

Comparative Embodiment 1

An amorphous alloy composite material having a general formula $((Zr_{0.98}Hf_{0.02})_{59}Ti_{15}Cu_7Ni_6Be_{13})_{95}Nb_5$ was prepared by the steps of:

1) preparing a mixture of $(Zr_{0.98}Hf_{0.02})$, Ti, Cu, Ni, Nb and Be: mixing the compositions of $(Zr_{0.98}Hf_{0.02})$, Ti, Cu, Ni, Nb and. Be each having a purity of 99.9% according to the atomic weight ratios as indicated in the general formula mentioned above to obtain a mixture, and an oxygen content is 2200 ppm; and 2) preparing a sheet of $((Zr_{0.98}Hf_{0.02})_{59}Ti_{15}Cu_7Ni_6Be_{13})_{95}Nb_5$ that was labeled S2 was prepared by:

placing the mixture of Step 1) in a vacuum arc furnace of a fast solidification equipment; and melting the alloy raw material for 4 minutes at a temperature of 1100° C. using Ar as a protective gas (with a purity of 99.9%) to melt completely and to form an ingot; and then melting the ingot again and performing die casting by a mould on a vacuum die casting machine with the mould being cooled to room temperature by water at a cooling speed of $10^2$K/s to form the sheet S2 of $((Zr_{0.98}Hf_{0.02})_{59}Ti_{15}Cu_7Ni_6Be_{13})_{95}Nb_5$.

An oxygen content of the sheet S2 was about 2400 ppm according to the testing method as described in Embodiment 1.

The crystalline phase of the sheet S2 had a volume percent of 6% according to the testing method of as described in Embodiment 1.

Embodiment 2

The method for manufacturing a sheet S3 was substantially the same as that described in Embodiment 1, except that the mold was cooled to room temperature with a cooling speed of $10^4$K/s in the step 2).

An oxygen content of plate S3 was about 900 ppm according to the testing method as 25 described in Embodiment 1.

The crystalline phase of plate S3 had a volume percent of 28% according to the testing method as described in Embodiment 1.

Embodiment 3

An amorphous alloy composite material having a general formula of $(Zr_{0.95}Hf_{0.05})_{51}Ti_{18}Cu_{10}Ni_2Be_{19})$ was prepared by the steps of:

1) preparing a mixture of $(Zr_{0.95}Hf_{0.05})$, Ti, Cu, Ni, Nb and Be:

mixing the compositions of $(Zr_{0.95}Hf_{0.05})$, Ti, Cu, Ni, and Be each having a purity of 99.9% according to the atomic weight ratios as indicated in the general formula mentioned above to obtain a mixture, and an oxygen content is 600 ppm; and 2) preparing a sheet of $(Zr_{0.95}Hf_{0.05})_{51}Ti_{18}Cu_{10}Ni_2Bc_{19}$ that was labeled S4 was prepared by:

placing the mixture of Step 1) in a vacuum are furnace of a fast solidification equipment; and melting the alloy raw material for 4 minutes at a temperature of 1100° C. using Ar as a protective gas (with a purity of 99.9%) to melt completely and to form an ingot; and then melting the ingot again and performing die casting by a mould on a vacuum die casting machine with the mould being cooled to room temperature by water at a cooling speed of $10^2$K/s to form the sheet S4 of $(Zr_{0.95}Hf_{0.05})_{51}Ti_{18}Cu_{10}Ni_2Be_{19})$.

An oxygen content of plate S4 was about 1300 ppm according to the testing method as described in Embodiment 1.

The crystalline phase of plate S4 had a volume percent of 20% according to the testing method as described in Embodiment 1.

Embodiment 4

An amorphous alloy composite material having a general formula $((Zr_{0.92}Hf_{0.08})_{51}Ti_{18}Cu_{10}Ni_2Be_{19})Nb_8$ was prepared by the steps of:

1) preparing a mixture of $(Zr_{0.92}Hf_{0.08})$, Ti, Cu, Ni, Nb and Be:

mixing the compositions of $(Zr_{0.92}Hf_{0.08})$, Ti, Cu, Ni, Be and Nb each having a purity of 99.9% according to the atomic weight ratios as indicated in the general formula mentioned above 20 to obtain a mixture, and an oxygen content is 600 ppm; and 2) preparing a sheet of $((Zr_{0.92}Hf_{0.08})_{51}Ti_{18}Cu_{10}Ni_2Be_{19})_{92}Nb_5$ that was labeled S5 was prepared by:

placing the mixture of Step 1) in a vacuum arc furnace of a fast solidification equipment; and melting the alloy raw material for 4 minutes under a temperature of 1100° C. using Ar as a protective gas (with a purity of 99.9%) to melt completely and to form an ingot; and then melting the ingot again and performing die casting by a mould on a vacuum die casting machine with the mould being cooled to room temperature by water at a cooling speed of $10^2$K/s to form the sheet S5 of $((Zr_{0.92}Hf_{0.08})_{51}Ti_{18}Cu_{10}Ni_2Be_{19})_{92}Nb_8$.

An oxygen content of the sheet S5 was about 1900 ppm according to the testing method as described in Embodiment 1.

The crystalline phase of the sheet S5 had a volume percent of 16% according to the testing method as described in Embodiment 1.

Performance Testing

Bending Test

According to GB/T14452-93, a bending test of the amorphous alloy was carried out on a testing machine distributed by MTS Systems (Shenzhen) Co., Ltd, Shenzhen, China with a span of 50 millimeters ("mm") and a loading speed of 0.5 millimeters per minute ("mm/min"). The test results were shown in FIG. 1 and Table 1.

Microstructure Analysis

XRD Analysis

Figure 2:
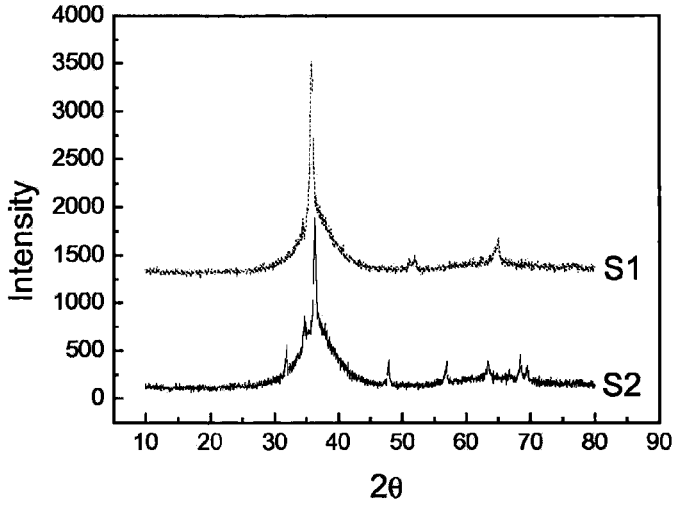
FIG. 2 shows an X-ray diffraction (XRD) graph of an amorphous alloy composite material according to an embodiment of the present disclosure.

XRD powder diffraction analysis is a phase analysis method to determine whether an alloy was amorphous. The test was carried out on a D-MAX2200PC X-ray powder diffractometer. With a copper target, an incident wavelength λ of 1.54060 Å, an accelerating voltage of 40 kilovolts ("KV") and a current of 20 milliampere ("mA"), the specimens were step-scanned with a step length for scanning of 0.04°. The test results thereof were shown in FIG. 2.

TABLE 1

| Embodiment No. | Sheet No. | Strength (MPa) | Plastic strain (%) |
|---|---|---|---|
| Embodiment 1 | S1 | 1902 | >13% |
| Comparative Embodiment 1 | S2 | 1987 | / |
| Embodiment 2 | S3 | 1923 | 7% |
| Embodiment 3 | S4 | 1955 | 5% |
| Embodiment 4 | S5 | 1970 | 2% |

Figure 3:
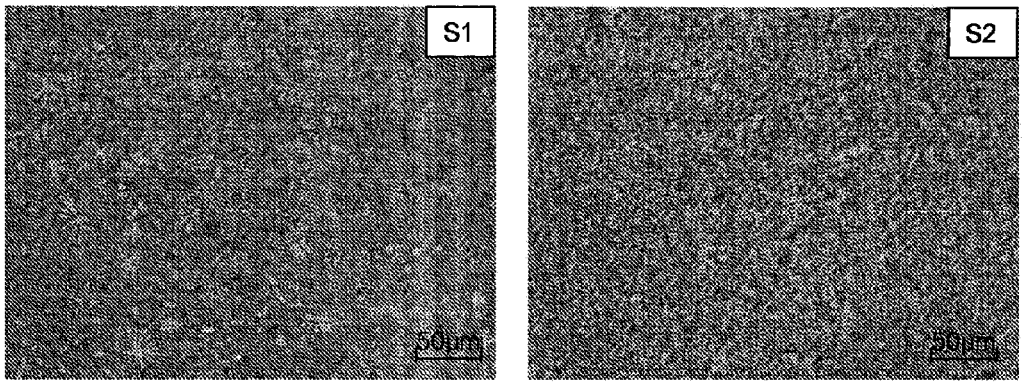
FIG. 3 shows optical micrographs for an amorphous alloy composite material according to an embodiment of the present disclosure.

According to XRD spectra of Embodiment 1 and Comparative Embodiment 1, it may be known that both materials from Embodiment 1 and Comparative Embodiment 1 have certain crystalline phases, but the difference in oxygen contents results in a significant difference in the structure of both of the materials. In conjunction with XRD spectra noted above of Embodiment 1 and Comparative Embodiment 1, some well-grown and snowflake-like equiaxed dendrites are dispersed uniformly on the amorphous matrix phase of the sheet S 1, accompanying with some initial crystalline phases, as shown in FIG. 3. For the sheet S2, some initial crystalline phases do exist, however, these initial crystalline phases are quite few, which does not grow sufficiently, and there is no desired equiaxed dendrites.

FIG. 1 shows a stress-strain curve for amorphous alloy composite materials according to embodiment 1 and Comparative Embodiment 1 of the present disclosure, in which the x-axis represents strain % and y-axis represents stress %. It can be known that there are cracks in the sheet S2 at a stress of about 2000 MPa, and has a total strain of 3.16% and a pure plastic strain of almost 0 before failure. In comparison with S2, the sheet Si yields at a stress of about 1800 MPa without cracks, resulting in a process softening phenomenon, the sheet Si has a total strain of 17% and a plastic strain of more than 13%, and there is no fracture failure during the whole test. represents strain % and y-axis represents stress %. It can be known that there are cracks in the sheet S2 at a stress of about 2000 MPa, and has a total strain of 3.16% and a pure plastic strain of almost 0 before failure. In comparison with S2, the sheet Si yields at a stress of about 1800 MPa without cracks, resulting in a process softening phenomenon, the sheet Si has a total strain of 17% and a plastic strain of more than 13%, and there is no fracture failure during the whole test.

As can be seen from test results as shown in FIG. 1, the amorphous alloy composite materials of Embodiments 1-4 described in the present disclosure all have significantly higher plastic strain than that shown in Comparative Embodiment 1, which indicates that amorphous alloy composite materials of the present disclosure have better plasticity than that of the composite material existing in the art.

Although the present disclosure have been described in detail with reference to several embodiments, additional variations and modifications exist within the scope and spirit as described and defined in the following claims.

What is claimed is:

1. An amorphous alloy composite material comprising a matrix phase and a reinforcing phase, wherein:

the matrix phase is a continuous and amorphous phase;

the reinforcing phase comprises a plurality of equiaxed crystalline phases dispersed in the matrix phase; and the amorphous alloy composite material has an oxygen content of less than about 2100 ppm, wherein the amorphous alloy composite material has a composition represented by the general formula of $((Zr_{1-a}Hf_a)_bTi_cCu_dNi_eBe_f)_{100-x}Nb_x$ where:

a is an atomic weight ratio of Hf to a total atomic weight of Zr and Hf, wherein $0.01<a<0.1$;

b, c, d, e, and f are atomic weight ratios, wherein $50<b<65$, $10<c<20$, $2<d<10$, $1<e<10$, and $4<f<20$, and $b+c+d+e+f=100$; and x is the atomic weight ratio of Nb, wherein $0<x<10$.

2. The amorphous alloy composite material according to claim 1, wherein the reinforcing phase ranges from about 10% to about 70% by volume of the amorphous alloy composite material.

3. The amorphous alloy composite material according to claim 1, wherein x has a range of about $1<x<6$.

* * * * *